United States Patent [19]

Stumm et al.

[11] Patent Number: 4,773,372

[45] Date of Patent: Sep. 27, 1988

[54] MULTI-ENGINE DRIVE SYSTEM

[75] Inventors: Hans-Peter Stumm, Tamm; Ernst Wild, Weissach-Flacht, both of Fed. Rep. of Germany

[73] Assignee: Robert Bosch GmbH, Stuttgart, Fed. Rep. of Germany

[21] Appl. No.: 138,944

[22] Filed: Dec. 29, 1987

[30] Foreign Application Priority Data

Jan. 3, 1987 [DE] Fed. Rep. of Germany ..... 3700088

[51] Int. Cl.[4] ..... F02D 25/00; F02D 9/08; F02B 77/08

[52] U.S. Cl. ..... 123/399; 123/DIG. 8

[58] Field of Search ..... 123/DIG. 8, 399, 361

[56] References Cited

U.S. PATENT DOCUMENTS

| | | | |
|---|---|---|---|
| 1,024,098 | 4/1912 | Price | 123/DIG. 8 |
| 1,318,209 | 10/1919 | Jouffret | 123/DIG. 8 |
| 4,167,857 | 9/1979 | Nishijima et al. | 123/DIG. 8 |
| 4,231,334 | 11/1980 | Peter | 123/440 |
| 4,442,805 | 4/1984 | Yamakawa | 123/DIG. 8 |

FOREIGN PATENT DOCUMENTS 1413079 11/1975 United Kingdom .

*Primary Examiner*—Willis R. Wolfe
*Assistant Examiner*—Eric R. Carlberg
*Attorney, Agent, or Firm*—Walter Ottesen

[57] ABSTRACT

The invention is directed to a multi-engine drive system with at least two engines which have a common crankshaft. In order to test if both engines are operating properly, a mutually oppositely directed modulation of the throttle flap angles of the throttle flaps is caused by a control unit to occur periodically in the context of a test function. If this test function causes a change in the rotational speed of the crankshaft, then this means that the two engines are no longer operating symmetrically so that a disturbance is present. In this way, a continuous monitoring of the operation of both engines is provided.

4 Claims, 2 Drawing Sheets

MULTI-ENGINE DRIVE SYSTEM

FIELD OF THE INVENTION

The invention relates to a multi-engine drive system with at least two engines and a common crankshaft or rigidly coupled crankshafts wherein each engine has its own mixture preparation apparatus and ignition apparatus. In this system, a common control apparatus controls the throttle flaps of both engines.

BACKGROUND OF THE INVENTION

From German published patent application DE-OS No. 22 55 874 and U.S. Pat. No. 4,231,334, it is known to drive several engines in combination with a common crankshaft with the engines each having their own mixture-preparation apparatus and ignition apparatus. This can relate to a four cylinder V-engine having two mixture-preparation apparatus and two ignition apparatus. The positioning motors of the throttle flaps are synchronously actuated by a common control. If one engine of such a multi-engine drive system should fail, then this does not mean that the crankshaft comes to a standstill; instead, the malfunctioning engine is moved along by the other engine. For example, in the event of a failure of the ignition, this can lead to damage of the engine which is moved along.

SUMMARY OF THE INVENTION

A multi-engine drive system according to the invention affords the advantage that a malfunction announcement occurs when one of the engines malfunctions so that the drive system switches off and the occurring malfunction can be eliminated. In this way, greater engine damage can be prevented.

An operational disturbance or the malfunction of an engine can be established in a two-engine arrangement by varying the position angle of the throttle flap in a two-engine system. Furthermore, it is possible to ascertain which engine is defective.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
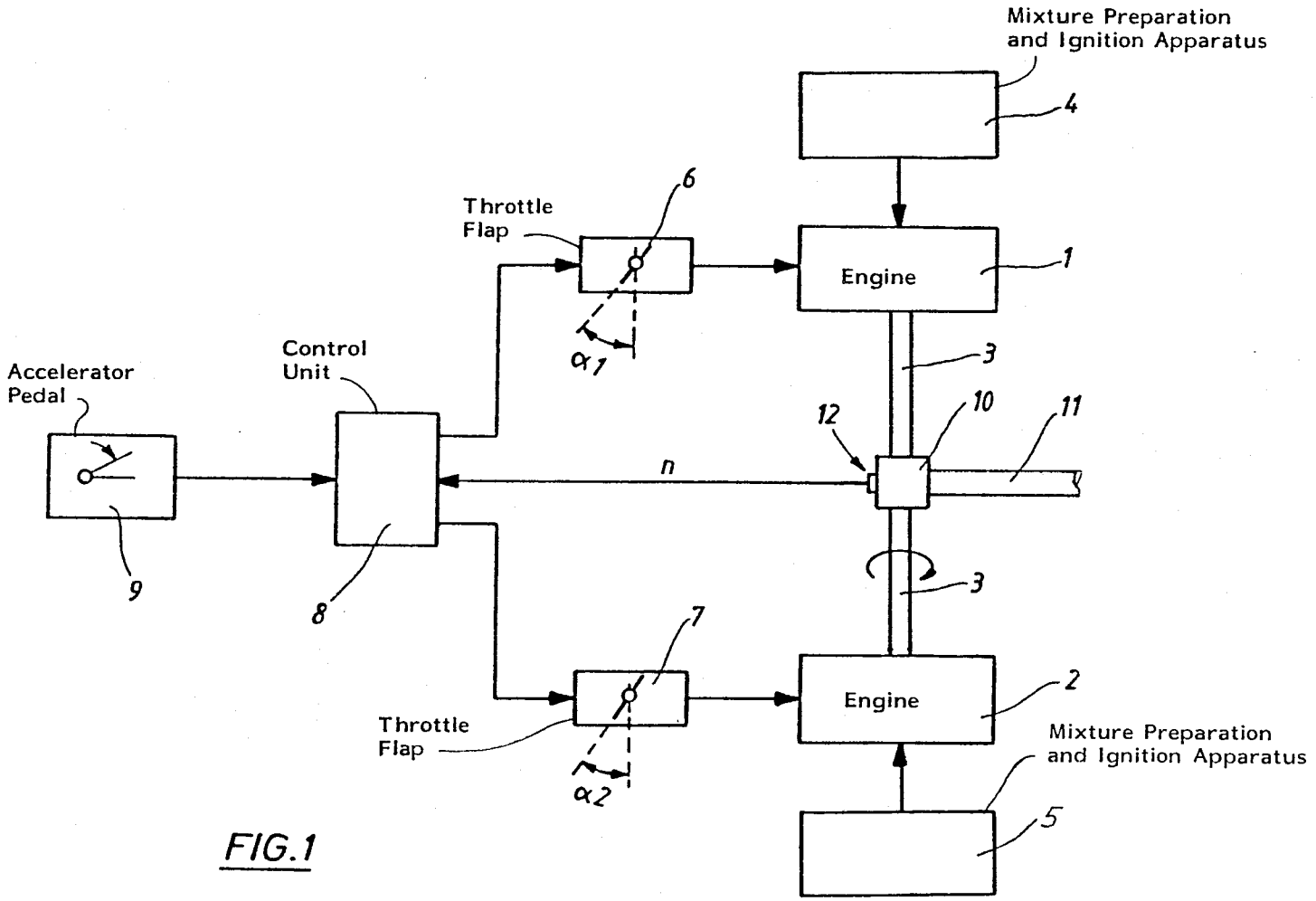
FIG. 1 is a block diagram of a drive system according to the invention having two engines; and, FIG. 2 shows the angular position of the throttle flap and the rotational speed of the crankshaft both as a function of time.

The drive system shown in FIG. 1 has two engines (1, 2) with a common crankshaft 3. On the other hand, the crankshafts of the engines can be rigidly coupled. Separate mixture preparation and ignition apparatus (4, 5) are provided for corresponding ones of the engines (1, 2). The throttle flaps (6, 7) of the respective engines (1, 2) are controlled from a common control unit 8 with respect to their throttle flap angles ($\alpha 1$, $\alpha 2$).

The control unit 8 is coupled with the accelerator pedal 9 at the input end thereof which transmits the vehicle speed and acceleration or deceleration desired by the driver of the vehicle to the control unit 8 in the form of an electrical signal. The control unit 8 actuates the position motors of the throttle flaps 6 and 7 in accordance with the desire of the driver in order to cause a corresponding change in the engine speed.

The crankshaft 3 drives an output shaft 11 via a transmission 10. A rotational speed sensor 12 is mounted in the region of the crankshaft 3 and delivers an electrical signal to the control unit 8 corresponding to the particular rotational speed.

Figure 2:
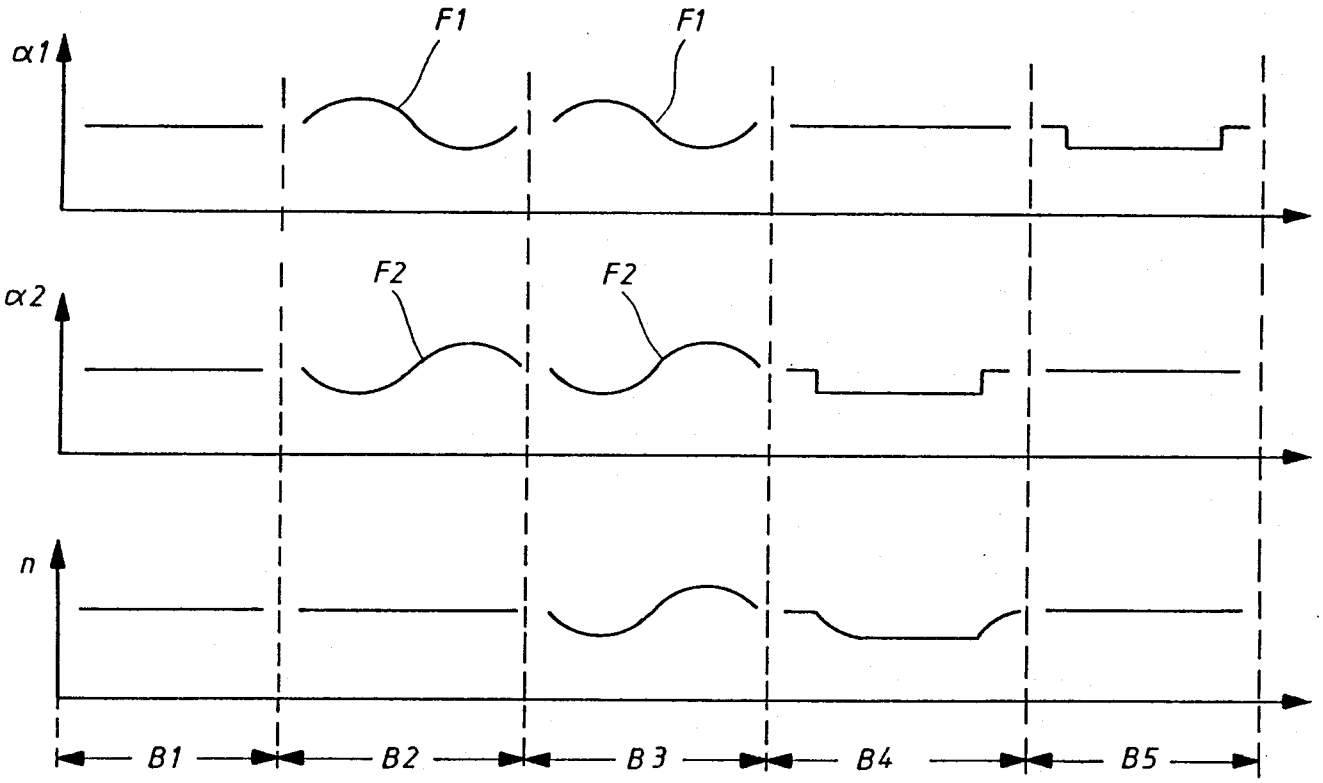

In order to detect operational disturbances which occur in one of the two engines (1, 2), the control unit 8 applies the periodic test functions (F1, F2) shown in FIG. 2 to the positioning motors of the throttle flaps (6, 7). These test functions (F1, F2) effect a modulation of the throttle flap angles of both throttle flaps (6, 7). These test functions (F1, F2) are mirror images of each other and run in mutually opposite directions so that an increase in speed caused by the modulation in one of the two engines attempts to effect a speed reduction in the other engine. However, since the engines (1, 2) are rigidly coupled via the crankshaft 3, the torque changes which are caused by the modulation of the throttle flap angles are cancelled so that no changes in speed of the crankshaft 3 occur during the undisturbed operation.

In contrast to the above, if one of the two engines is defective so that this one engine is driven only by the other engine, an oppositely directed change of the throttle flap angle of both throttle flaps effects the condition that a corresponding change in torque is developed only by the properly operating engine; whereas, no change in torque is effected by the defective engine. This then causes a corresponding engine speed modulation which is detected by the speed sensor 12 and transmitted to the control unit 8. The control unit 8 recognizes the speed modulation occurring in correspondence to the test function and issues a disturbance signal. This can occur in a simple manner by means of a signal lamp.

FIG. 2 shows the throttle flap angles $\alpha 1$ and $\alpha 2$ of the respective throttle flaps 6 and 7 as a function of time (t). The course of the rotational speed (n) is shown in the lowermost diagram of FIG. 2.

During the first operational phase Bl, the throttle flap angles $\alpha 1$ and $\alpha 2$ are constant so that the speed (n) also remains constant.

During a second operational phase B2, the throttle flap angles $\alpha 1$ and $\alpha 2$ are periodically changed by means of the test functions F1 and F2 in equal amounts and in mutually opposite directions. Since the speed (n) remains constant also in this operational phase B2, the two engines 1 and 2 are functioning properly.

In a further operational phase B3, a modulation of the throttle flap angles $\alpha 1$ and $\alpha 2$ occurs again; however, the crankshaft speed (n) in this operational phase B3 exhibits a corresponding modulation. This speed modulation is detected by the control unit 8 (FIG. 1) and a signal is provided indicating the disturbance.

Furthermore, the control unit 8 causes a directed displacement of the throttle flap angle $\alpha 2$ to occur in operational phase B4 which causes a corresponding change in speed. From this it can be concluded that engine 2 is functioning properly so that the disturbance determined previously in operational phase B3 must obviously be present in engine 1.

A further test to establish which engine is defective is given in the operational phase B5. Here, a displacement of the throttle flap angle $\alpha 1$ is undertaken which, however, effects no change in speed (n). From this it is concluded that it is engine 1 which must be defective.

The periodic test functins F1 and F2 can be superposed in form of an amplitude modulation onto the throttle flap angles $\alpha 1$ and $\alpha 2$ in more or less longer time intervals for testing the engine operation.

It is understood that the foregoing description is that of the preferred embodiments of the invention and that various changes and modifications may be made thereto without departing from the spirit and scope of the invention as defined in the appended claims.

What is claimed is:

1. A multi-engine drive system comprising:

a first engine having a first throttle flap;

a first mixture preparation and ignition apparatus corresponding to said first engine;

a second engine having a second throttle flap;

a second mixture preparation and ignition apparatus corresponding to said second engine;

crankshaft means common to said engines so as to be driven thereby;

a control unit common to said first and second engines for controlling and modulating the position of said first throttle flap with a periodic first test function F1 and for controlling and modulating the position of said second throttle flap with a periodic second test function F2, said second test function F2 being the mirror image of said first test function F1; and, detection means for detecting a modulation of the rotational speed (n) of said crankshaft means when one of said engines is defective and to provide a signal indicative of the defect.

2. The multi-engine drive system of claim 1, said control unit being connected to said detection means for receiving said signal and including means for effecting a change in the throttle flap angle of the other one of said engines and for evaluating the change in said speed (n) caused by said angle change for determining said one engine which is defective.

3. The multi-engine drive system of claim 1, wherein said first and second engines have respective first and second crankshafts, said crankshafts being rigidly connected together to define said crankshaft means.

4. A multi-engine drive system comprising:

a first engine having a first throttle flap;

a first mixture preparation apparatus corresponding to said first engine a second engine having a second throttle flap;

a second mixture preparation apparatus corresponding to said second engine;

crankshaft means common to said engines so as to be driven thereby;

a control unit common to said first and second engines for controlling and modulating the position of said first throttle flap with a periodic first test function F1 and for controlling and modulating the position of said second throttle flap with a periodic second test function F2, said second test function F2 being the mirror image of said first test function F1;

detection means mounted on said crankshaft means for detecting a modulation of the rotational speed (n) thereof in response to said test functions when one of said engines is defective and to provide a signal indicative of the defect; and, said control unit being connected to said detection means for receiving said signal and recognizing said speed modulation to provide a signal indicating the presence of the defect.

* * * * *